US010235937B2

(12) United States Patent
Li et al.

(10) Patent No.: US 10,235,937 B2
(45) Date of Patent: Mar. 19, 2019

(54) ORGANIC LIGHT-EMITTING DISPLAY PANEL AND DRIVING METHOD THEREOF, AND ORGANIC LIGHT-EMITTING DISPLAY DEVICE

(71) Applicant: SHANGHAI TIANMA AM-OLED CO., LTD., Shanghai (CN)

(72) Inventors: Yue Li, Shanghai (CN); Gang Liu, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 0 days.

(21) Appl. No.: 15/715,094

(22) Filed: Sep. 25, 2017

(65) Prior Publication Data

US 2018/0012546 A1 Jan. 11, 2018

(30) Foreign Application Priority Data

May 17, 2017 (CN) ..... 2017 1 0349505

(51) Int. Cl.
*G09G 3/3233* (2016.01)
*G09G 3/3258* (2016.01)

(52) U.S. Cl.
CPC ..... *G09G 3/3233* (2013.01); *G09G 3/3258* (2013.01); *G09G 2300/043* (2013.01);
(Continued)

(58) Field of Classification Search
CPC ..... G09G 2300/043; G09G 2300/0452; G09G 2300/0819; G09G 2310/0202;
(Continued)

(56) References Cited

U.S. PATENT DOCUMENTS 6,486,470 B2 * 11/2002 Huang ..... G09G 3/22 250/307
7,619,597 B2 * 11/2009 Nathan ..... G09G 3/3233 345/82

(Continued)

FOREIGN PATENT DOCUMENTS

CN 104252836 A 12/2014
CN 105096820 A 11/2015

(Continued)

*Primary Examiner* — Michael J Jansen, II
(74) *Attorney, Agent, or Firm* — Kilpatrick Townsend & Stockton LLP

(57) ABSTRACT

The present application discloses an organic light-emitting display panel and a driving method thereof, as well as an organic light-emitting display device. A specific implementation of the organic light-emitting display panel comprises: an array arrangement comprising a plurality of pixel units, a plurality of data lines and a plurality of reference signal lines, wherein each pixel unit comprises a first subpixel, a second subpixel and a third subpixel, and a color of the first subpixel, a color the second subpixel and a color of the third subpixel differ from one another; a pixel driving circuit is formed in each subpixel, and comprises a driving transistor and an organic light-emitting diode; and the first subpixel, the second subpixel and the third subpixel of an identical pixel unit are electrically connected with a given reference signal line.

12 Claims, 10 Drawing Sheets

(52) U.S. Cl.
CPC ..... *G09G 2300/0452* (2013.01); *G09G 2300/0819* (2013.01); *G09G 2310/0202* (2013.01); *G09G 2310/0248* (2013.01); *G09G 2320/0233* (2013.01); *G09G 2320/045* (2013.01); *G09G 2330/021* (2013.01)

(58) Field of Classification Search
CPC ... G09G 2310/0248; G09G 2320/0233; G09G 2320/045; G09G 2330/021; G09G 3/3233; G09G 3/3258
See application file for complete search history.

(56) References Cited

U.S. PATENT DOCUMENTS 7,924,249 B2 * 4/2011 Nathan ..... G09G 3/3233 345/78
8,199,074 B2 * 6/2012 Wang ..... G09G 3/006 345/76
8,289,247 B2 * 10/2012 Min ..... G09G 3/3233 345/82
8,558,825 B2 * 10/2013 Bae ..... G09G 3/3233 315/169.3
9,035,976 B2 * 5/2015 Lee ..... G09G 3/3283 345/691
9,076,387 B1 * 7/2015 Lee ..... G09G 3/20
9,122,339 B2 * 9/2015 Yang ..... G06F 3/0412
9,218,768 B2 * 12/2015 Lee ..... G09G 3/3291
9,236,011 B2 * 1/2016 Mizukoshi ..... G09G 3/3291
9,437,167 B2 * 9/2016 Shin ..... G09G 3/3233
9,514,686 B2 * 12/2016 Lee ..... G09G 3/3291
9,595,223 B2 * 3/2017 Yang ..... G09G 3/3233
9,646,533 B2 * 5/2017 Hong ..... G09G 3/3233
9,715,853 B2 * 7/2017 Kim ..... G09G 3/3266
9,818,344 B2 * 11/2017 Lin ..... G09G 3/3233
9,830,861 B2 * 11/2017 Park ..... G09G 3/3258
9,842,546 B2 * 12/2017 Kim ..... G09G 3/3291
9,858,862 B2 * 1/2018 Kwon ..... G09G 3/3258
9,928,776 B2 * 3/2018 Kim ..... G09G 3/3233
9,953,568 B2 * 4/2018 Yu ..... G09G 3/3233
9,990,888 B2 * 6/2018 Oh ..... G09G 3/12
10,032,414 B2 * 7/2018 Kim ..... G09G 3/3258
10,062,327 B2 * 8/2018 Tani ..... G09G 3/3233
10,068,520 B2 * 9/2018 Xiang ..... G09G 3/3208
2002/0053946 A1 * 5/2002 Huang ..... G09G 3/22 330/127
2006/0158402 A1 * 7/2006 Nathan ..... G09G 3/3233 345/82
2007/0195020 A1 * 8/2007 Nathan ..... G09G 3/3233 345/76
2008/0036703 A1 * 2/2008 Wang ..... G09G 3/006 345/76
2010/0073357 A1 * 3/2010 Min ..... G09G 3/3233 345/214
2010/0253659 A1 * 10/2010 Sugimoto ..... G09G 3/3233 345/206
2011/0122119 A1 * 5/2011 Bae ..... G09G 3/3233 345/211
2013/0050292 A1 * 2/2013 Mizukoshi ..... G09G 3/3291 345/690
2014/0022289 A1 * 1/2014 Lee ..... G09G 3/3283 345/691
2014/0092076 A1 * 4/2014 Lee ..... G09G 3/3291 345/212
2014/0152191 A1 * 6/2014 Yang ..... G09G 3/3233 315/240
2014/0168127 A1 * 6/2014 Yang ..... G06F 3/0412 345/173
2015/0061981 A1 * 3/2015 Lee ..... G09G 3/3291 345/77
2015/0062192 A1 * 3/2015 Kim ..... G09G 3/3291 345/690
2015/0130785 A1 * 5/2015 Shin ..... G09G 3/3233 345/213
2015/0170565 A1 * 6/2015 Hong ..... G09G 3/3233 345/212
2015/0325174 A1 * 11/2015 Yu ..... G09G 3/3233 345/77
2016/0189615 A1 * 6/2016 Kwon ..... G09G 3/3258 345/214
2016/0189617 A1 * 6/2016 Park ..... G09G 3/3258 345/690
2016/0189621 A1 * 6/2016 Kim ..... G09G 3/3258 345/215
2016/0351096 A1 * 12/2016 Tani ..... G09G 3/3233
2017/0004776 A1 * 1/2017 Park ..... G09G 3/3233
2017/0039952 A1 * 2/2017 Kim ..... G09G 3/3233
2017/0061865 A1 * 3/2017 Park ..... G09G 3/325
2017/0132977 A1 * 5/2017 Kim ..... G09G 3/3225
2017/0132979 A1 * 5/2017 Oh ..... G09G 3/12
2017/0162113 A1 * 6/2017 Lin ..... G09G 3/3233
2017/0193901 A1 * 7/2017 Wang ..... G09G 3/3233
2017/0221423 A1 * 8/2017 Xiang ..... G09G 3/3291
2017/0294166 A1 * 10/2017 Kim ..... G09G 3/3266
2017/0301286 A1 * 10/2017 Xiang ..... G09G 3/3208
2018/0012546 A1 * 1/2018 Li ..... G09G 3/3233
2018/0061296 A1 * 3/2018 Shim ..... G09G 3/006
2018/0068617 A1 * 3/2018 Lin ..... G09G 3/3233
2018/0083078 A1 * 3/2018 Park ..... H01L 27/3248
2018/0122294 A1 * 5/2018 Do ..... G09G 3/3225
2018/0130423 A1 * 5/2018 Kim ..... G09G 3/14
2018/0151126 A1 * 5/2018 Jeong ..... H01L 27/3276
2018/0151129 A1 * 5/2018 Park ..... G09G 3/3233
2018/0151636 A1 * 5/2018 Park ..... H01L 27/3276
2018/0151658 A1 * 5/2018 Jeong ..... H01L 27/3258
2018/0174522 A1 * 6/2018 Lee ..... G09G 3/3258
2018/0212183 A1 * 7/2018 Ma ..... H01L 51/5203

FOREIGN PATENT DOCUMENTS

CN 105761678 A 7/2016
KR 20170026929 A 3/2017

* cited by examiner

ORGANIC LIGHT-EMITTING DISPLAY PANEL AND DRIVING METHOD THEREOF, AND ORGANIC LIGHT-EMITTING DISPLAY DEVICE

CROSS-REFERENCE TO RELATED APPLICATION

This application is related to and claims priority from Chinese Patent Application No. 201710349505.2, filed on May 17, 2017, entitled "Organic Light-Emitting Display Panel and Driving Method thereof, and Organic Light-Emitting Display Device," the entire disclosure of which is hereby incorporated by reference for all purposes.

TECHNICAL FIELD

The present application relates to the technical field of display, and specifically to an organic light-emitting display panel and a driving method thereof, and an organic light-emitting display device.

BACKGROUND

An organic light-emitting diode (OLED) is a diode that realizes display using reversible color changes generated by an organic semiconductor material driven by a current. A basic structure of an OLED display device usually includes a hole transport layer, a light-emitting layer, and an electron transport layer. When a power supply supplies an appropriate voltage, a hole of an anode and electrons of a cathode can be combined together in the light-emitting layer to produce light. Compared with a thin-film field-effect transistor liquid crystal display, the OLED display device is characterized by high visibility and high brightness, more energy-efficient, light-weight, and thin in thickness. Therefore, the OLED display device is regarded as one of the most promising products in the twenty-first Century.

Because the brightness of the OLED is related to the magnitude of the current passing through the OLED, the electrical properties of a thin-film transistor used for driving will directly influence the display effect, and particularly a threshold voltage of the thin-film transistor often drifts to enable the entire OLED display device to generate a problem of uneven brightness.

In order to improve the display effect of the OLED, the threshold voltage of the driving transistor usually needs to be detected in real time, and pixel compensation is then carried out on the OLED through the pixel driving circuit. The existing pixel driving circuit requires a large number of metal wires to detect a threshold voltage of the driving transistor, which results in that the pixel driving circuit occupies a larger space in the OLED display device, and a narrow frame of the OLED display device is difficult to realize.

SUMMARY

The present application aims to provide an organic light-emitting display panel and a driving method thereof, and an organic light-emitting display device to solve the technical problems mentioned in the background section.

In a first aspect, the present application provides an organic light-emitting display panel, including: an array arrangement including a plurality of pixel units, a plurality of data lines and a plurality of reference signal lines; each pixel unit includes a first subpixel, a second subpixel and a third subpixel, and a color of the first subpixel, a color of the second subpixel and a color of the third subpixel differ from one another; a pixel driving circuit is formed in each subpixel, and the pixel driving circuit includes a driving transistor and an organic light-emitting diode; and the first subpixel, the second subpixel and the third subpixel of an identical pixel unit are electrically connected with a given reference signal line.

In a second aspect, the present application provides a driving method for the organic light-emitting display panel and applied to the organic light-emitting display panel described in the above embodiment, the working time of the organic light-emitting display panel includes a threshold detection phase, and the method includes: sequentially providing data signals to the data lines to drive the first subpixel, the second subpixel and the third subpixel in each pixel unit; and acquiring a threshold voltage of each driving transistor in the first subpixel, the second subpixel and the third subpixel.

In a third aspect, the present application provides an organic light-emitting display device including the organic light-emitting display panel described in the above embodiment.

According to the organic light-emitting display panel and the driving method thereof, and the organic light-emitting display device provided by the present application, a plurality of pixels on the organic light-emitting display panel are divided into a plurality of pixel units, each pixel unit includes three subpixels, each column of the subpixels is electrically connected with one data line, and the three subpixels of an identical pixel unit are arranged in a row direction and are electrically connected with a given reference signal line. The organic light-emitting display panel of the present application, while implementing detection of a threshold voltage of a driving transistor, effectively reduces the number of metal wires arranged in each pixel driving circuit, reduces the space occupied by the pixel driving circuits in an OLED display device, and can realize a narrow frame more easily.

BRIEF DESCRIPTION OF THE DRAWINGS

Other features, objectives and advantages of the present application will become more apparent by reading a detailed description of the nonrestrictive embodiments made with reference to the following drawings.

DETAILED DESCRIPTION OF EMBODIMENTS

The present application will be further described below in detail in combination with the accompanying drawings and the embodiments. It should be appreciated that the specific embodiments described herein are merely used for explaining the relevant disclosure, rather than limiting the disclosure. In addition, it should be noted that, for the ease of description, only the parts related to the relevant disclosure are shown in the accompanying drawings.

It should also be noted that the embodiments in the present application and the features in the embodiments may be combined with each other on a non-conflict basis. The present application will be described below in detail with reference to the accompanying drawings and in combination with the embodiments.

Figure 1:
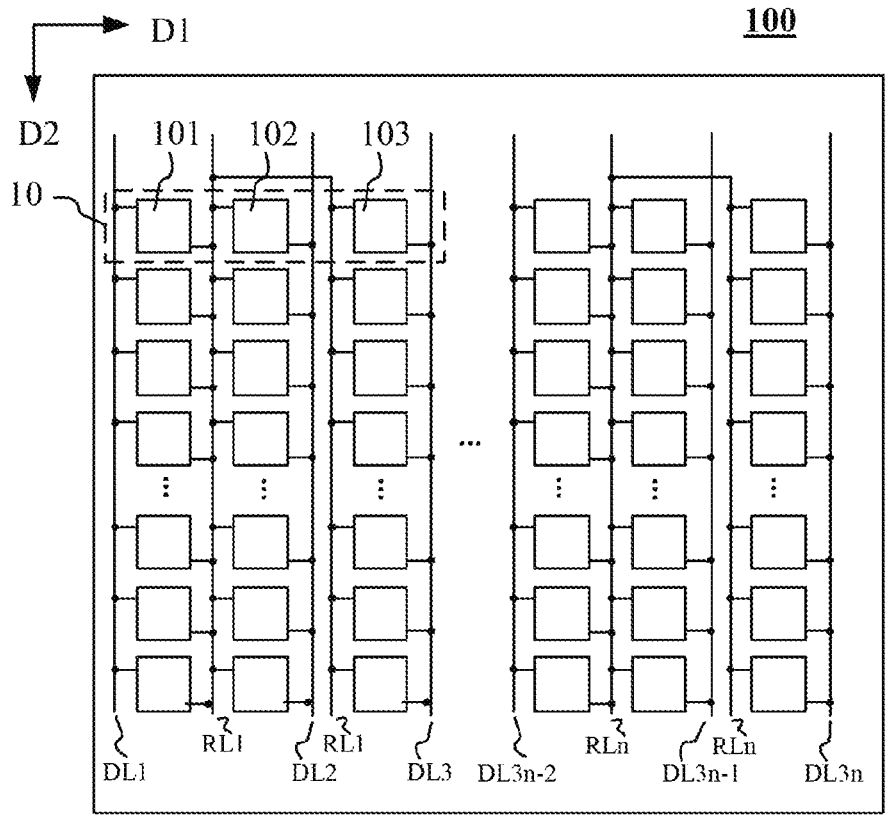
FIG. 1 is a structure diagram of one embodiment of the organic light-emitting display panel according to the present application.

FIG. 1 shows a structure diagram of one embodiment of the organic light-emitting display panel according to the present application. As shown in FIG. 1, the organic light-emitting display panel 100 of the present embodiment includes a plurality of pixel units 10, a plurality of data lines (DL1-DL3*n*) and a plurality of reference signal lines (RL1-RLn) in array arrangement. Wherein, each pixel unit 10 includes three subpixels, namely a first subpixel 101, a second subpixel 102 and a third subpixel 103. A pixel driving circuit is formed in each subpixel, the pixel driving circuit includes a driving transistor and an organic light-emitting diode, the driving transistor can provide driving current to the organic light-emitting diode, and the organic light-emitting diode turns on to emit light under the action of the driving current, thereby enabling the organic light-emitting display panel 100 to display a predetermined picture.

In the present embodiment, the first subpixel 101, the second subpixel 102 and the third subpixel 103 can be electrically connected with an identical reference signal line. As shown in FIG. 1, the first subpixel 101, the second subpixel 102 and the third subpixel 103 are electrically connected with a reference signal line RL1. The first subpixel 101, the second subpixel 102 and the third subpixel 103 can be arranged in a row direction (a first direction D1 shown in FIG. 1), and the first subpixel 101, the second subpixel 102 and the third subpixel 103 are equal in size.

The subpixels arranged in a column direction (a second direction D2 shown in FIG. 1) are electrically connected with a data line, and as shown in FIG. 1, a first column of the subpixels is electrically connected with a data line DL1, a second column of the subpixels is electrically connected with a data line DL2 . . . and a 3Nth column of the subpixels is electrically connected with a data line DL3N.

In this way, as the three subpixels share one reference signal line, the space occupied by the pixel driving circuit of each pixel in the organic light-emitting display panel 100 is effectively reduced; and meanwhile, during detection of a threshold voltage of a driving module of each subpixel, loads of the reference signal lines are consistent, so that the precision of the detected threshold voltage of each subpixel can be effectively improved.

According to the organic light-emitting display panel provided by the above embodiment of the present application, a pixel area on the organic light-emitting display panel is divided into a plurality of pixel units, each pixel unit includes three subpixels, each column of the subpixels is electrically connected with a data line, and the three subpixels of an identical pixel unit are arranged in a row direction and are electrically connected with a given reference signal line. The organic light-emitting display panel of the present application effectively reduces the number of metal wires arranged in each pixel driving circuit, and reduces the space occupied in the OLED display device.

In some optional implementations of the present embodiment, the pixel unit 10 may include a red subpixel R, a green subpixel G and a blue subpixel B, and each of the first subpixel 101, the second subpixel 102 and the third subpixel 103 is one of the red subpixel R, the green subpixel G and the blue subpixel B.

Figure 2:
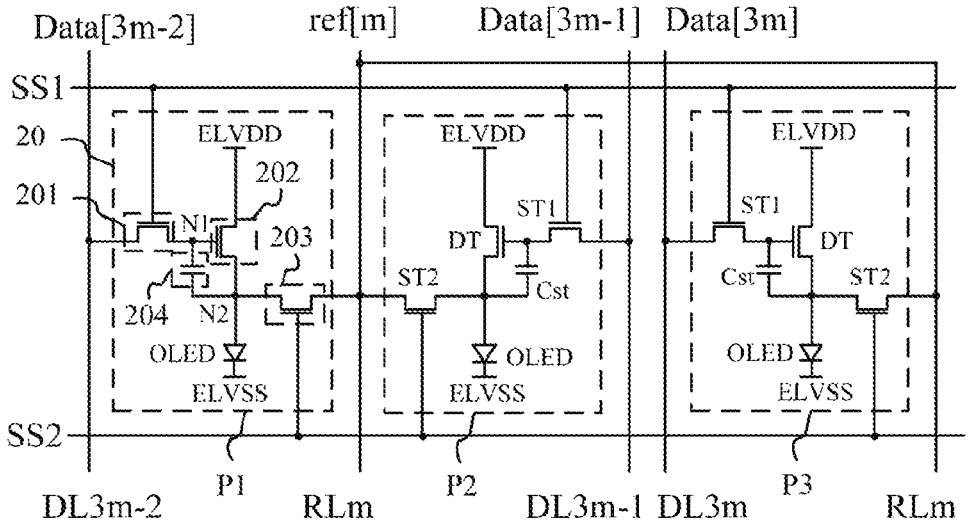
FIG. 2 is a structure diagram of a pixel driving circuit in a pixel unit of the organic light-emitting display panel shown in FIG. 1.

FIG. 2 shows a structure diagram of a pixel driving circuit in a pixel unit of the organic light-emitting display panel shown in FIG. 1. Each pixel driving circuit as shown in FIG. 2 drives each organic light-emitting diode (OLED). As shown in FIG. 2, the pixel unit of the organic light-emitting display panel includes subpixels P1, P2 and P3, and each subpixel has an identical pixel driving circuit.

The pixel driving circuit of the present embodiment may include: a data writing module 201, a driving module 202, an initialization module 203, an electricity storage module 204 and an organic light-emitting diode (OLED). Wherein, the data writing module 201 includes a first transistor ST1, the driving module 202 includes a driving transistor DT, the initialization module 203 includes a second transistor ST2, and the electricity storage module 204 includes a storage capacitor Cst.

The pixel driving circuit of the present embodiment may further include a first scanning line SS1 and a second scanning line SS2. Wherein, the subpixels P1, P2 and P3 are electrically connected with the first scanning line SS1 and the second scanning line SS2. Specifically, a gate of the first transistor ST1 in each subpixel is electrically connected with the first scanning line SS1, and a gate of the second transistor ST2 in each subpixel is electrically connected with the second scanning line SS2. In other words, the pixel driving circuit of the present embodiment controls turn-on and turn-off of the first transistor ST1 and the second transistor ST2 through the first scanning line SS1 and the second scanning line SS2.

The pixel driving circuit of the present embodiment may further include a plurality of data lines electrically connected with the subpixels extending in a column direction, including, as shown in FIG. 2, a data line DL3*m*-2 electrically connected with a subpixel P1, a data line DL3*m*-1 electrically connected with a subpixel P2, and a data line DL3*m* electrically connected with a subpixel P3. Specifically, a first electrode of each first transistor ST1 is electrically connected with a corresponding data line.

The pixel driving circuit of the present embodiment may further include a plurality of reference signal lines, a plurality of first supply voltage lines and a plurality of second supply voltage lines. Wherein, the three subpixels P1, P2 and P3 belonging to an identical pixel unit are electrically connected with an identical reference signal line. The first electrode of the driving transistor DT is electrically connected with a first supply voltage line, and the cathode of the organic light-emitting diode (OLED) is electrically connected with a second supply voltage line.

Specifically, a gate of the first transistor ST1 of each subpixel is electrically connected with the first scanning line SS1, a first electrode of the first transistor ST1 is electrically connected with a corresponding data line, and a second electrode of the first transistor ST1 is electrically connected with a gate of the driving transistor DT and one end of the storage capacitor Cst; a first electrode of the driving transistor DT is electrically connected with the first supply voltage line, and a second electrode of the driving transistor DT is electrically connected with the anode of the organic light-emitting diode (OLED), a second electrode of the second transistor ST2, and the other end of the storage capacitor Cst; a gate of the second transistor ST2 is electrically connected with the second scanning line SS2, and a first electrode of the second transistor ST2 is electrically connected with a corresponding reference signal line; and the cathode of the organic light-emitting diode (OLED) is electrically connected with a second supply voltage line.

The first scanning line SS1 provides a first control signal Scan1 for each first transistor ST1 to control turn-on and turn-off of the first transistor ST1. The second scanning line SS2 provides a second control signal Scan2 for each second transistor ST2 to control turn-on and turn-off of the second transistor ST2. The data lines are used for providing data signal voltages Vdata. The first supply voltage line and the second supply voltage line are used for providing a first supply voltage ELVDD and a second supply voltage ELVSS for each pixel driving circuit, and the first supply voltage ELVDD is greater than the second supply voltage ELVSS. The reference signal lines are used for providing reference signal voltages Vref for each second transistor ST2.

In some optional implementations of the present embodiment, the first transistor ST1, the second transistor ST2 and the driving transistor DT are P-type transistors.

In some optional implementations of the present embodiment, the organic light-emitting display panel may further include an integrated circuit not shown in FIG. 1, and the plurality of data lines, the plurality of reference lines and the plurality of scanning lines are electrically connected with the integrated circuit.

Figure 3A:
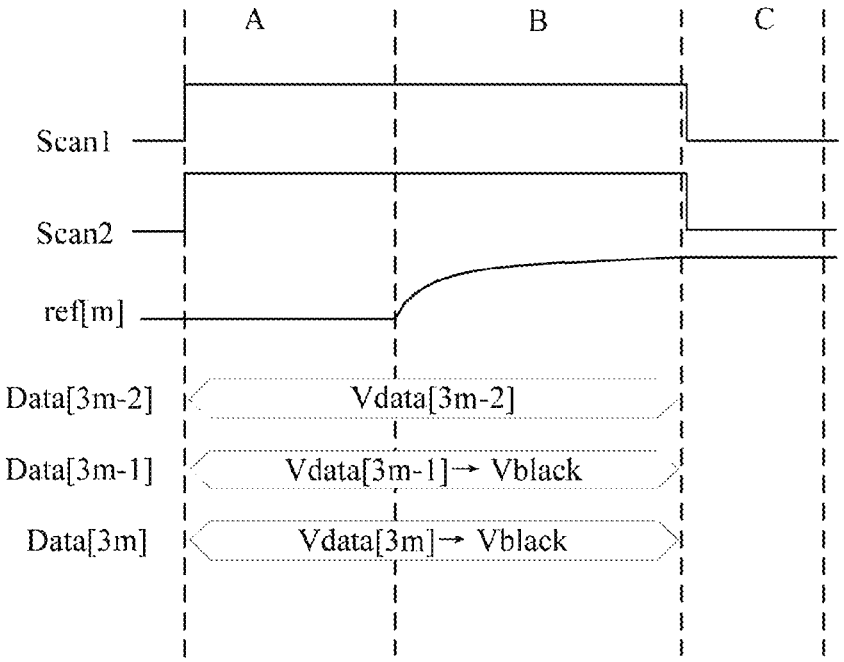
FIGS. 3*a*-3*d* are working time sequence diagrams of each pixel driving circuit of the pixel unit shown in FIG. 2 in different working phases.
Figure 3B:
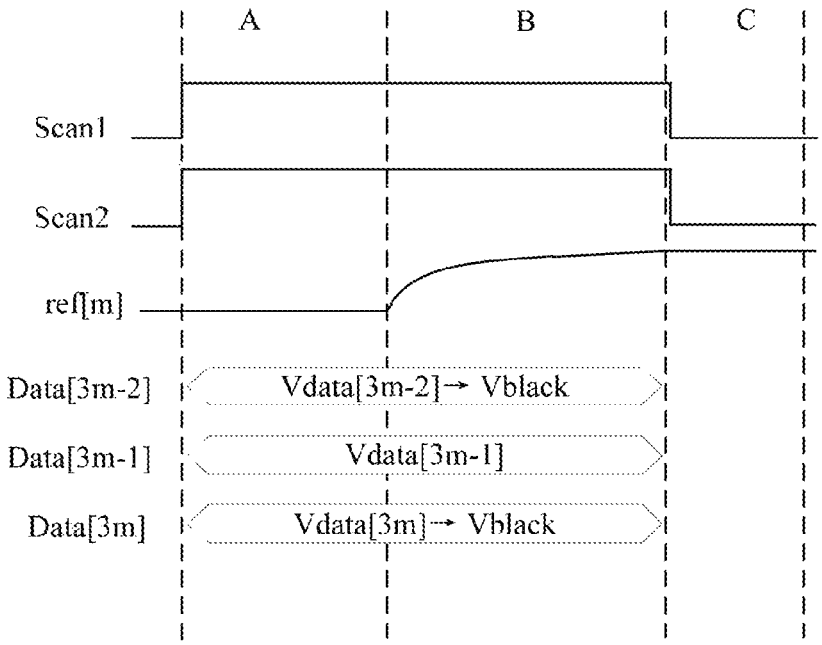
Figure 3C:
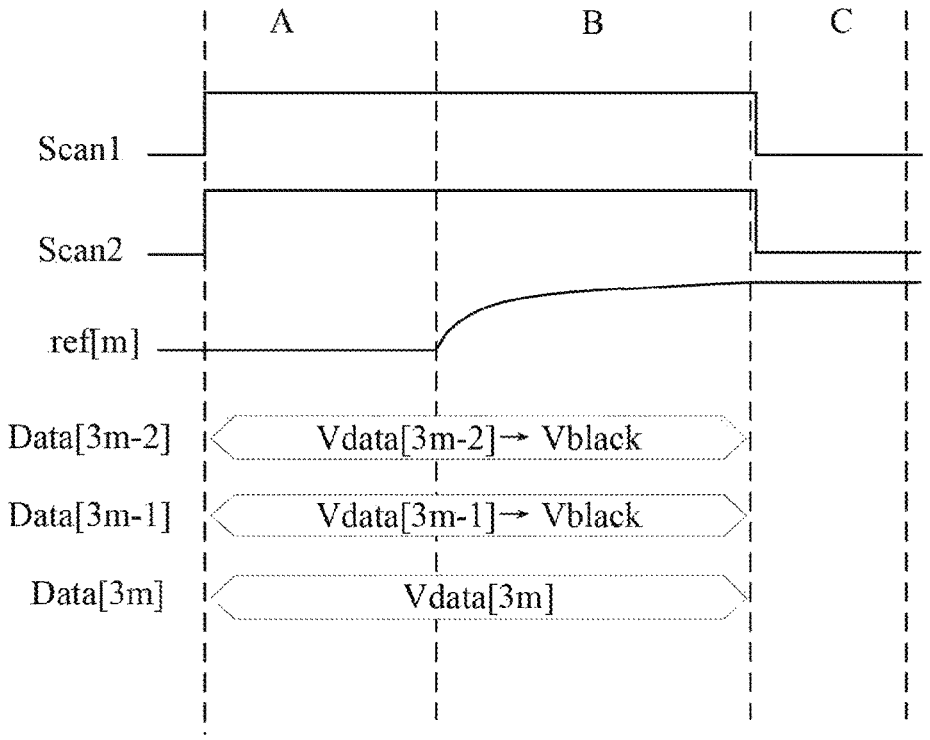
Figure 3D:
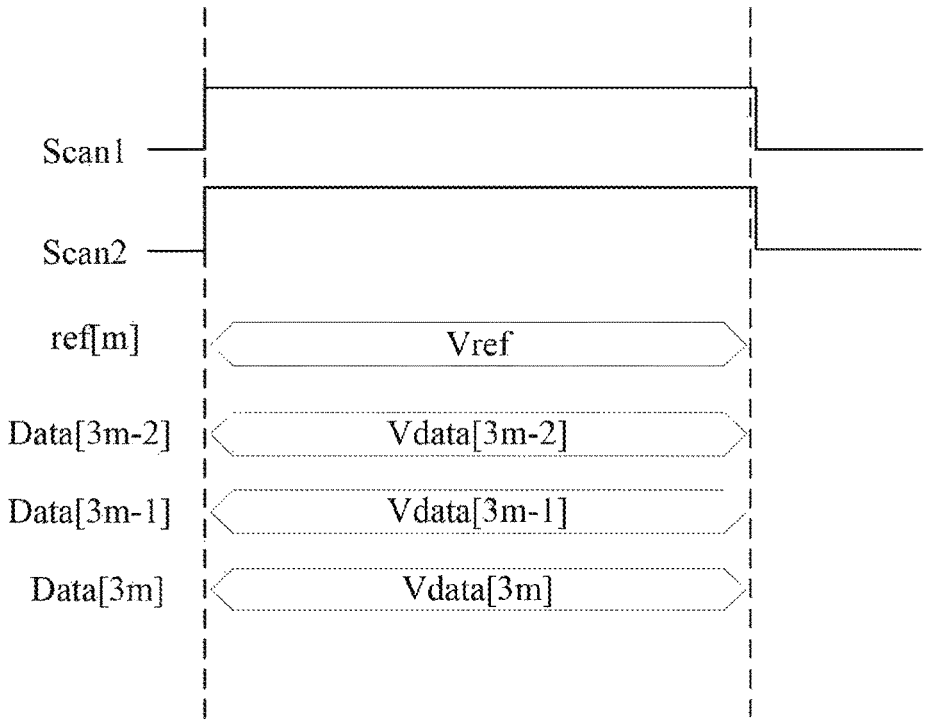

Hereinafter, in combination with FIGS. 3*a*-3*d*, refer to a working time sequence of the pixel driving circuit shown in FIG. 2. The working time of the organic light-emitting display panel includes a threshold detection phase and a light emitting phase, and each pixel driving circuit detects a threshold voltage of the driving transistor in each subpixel in the threshold detection phase. FIG. 3*a* is a working time sequence diagram of detection of a threshold voltage of the driving transistor of the first subpixel P1 of the pixel unit, FIG. 3*b* is a working time sequence diagram of detection of a threshold voltage of the driving transistor of the second subpixel P2 of the pixel unit, FIG. 3*c* is a working time sequence diagram of detection of a threshold voltage of the driving transistor of the third subpixel P3 of the pixel unit, and FIG. 3*d* is a working time sequence diagram of a display phase of the pixel unit. A working time sequence shown in FIG. 3*a* is a first subphase of the threshold detection phase of the pixel unit, a working time sequence shown in FIG. 3*b* is a second subphase of the threshold detection phase of the pixel unit, and a working time sequence shown in FIG. 3*c* is a third subphase of the threshold detection phase of the pixel unit.

As shown in FIG. 3*a*, the threshold detection phase of each pixel may include an initialization phase (such as a phase A in the Fig.), a discharge phase (such as a phase B in the Fig.) and an acquisition phase (such as a phase C in the Fig.). In the initialization phase A, the integrated circuit provides a first control signal Scan1 to the first scanning line SS1, a second control signal Scan2 to the second scanning line SS2, a data voltage signal Vdata[3*m*-2] to the data line DL3*m*-2, a black data voltage Vblack corresponding to a minimum data voltage (0V) to the data line DL3*m*-1 and the data line DL3*m* to turn off the subpixel P2 and the subpixel P3, and a reference voltage signal ref[m] to the reference signal line RLm. Because the first control signal Scan1 and the second control signal Scan2 are high levels, the first transistor ST1 and the second transistor ST2 of the subpixel P1 turn on, the first transistor ST1 transmits the data voltage signal Vdata[3*m*-2] to a first node N1, and the second transistor ST2 transmits the reference voltage Vref to a second node N2 to complete initialization of the driving transistor DT. As can be seen from FIG. 2, the first node N1 is the gate of the driving transistor DT, and the second node N2 is the second electrode of the driving transistor DT. At the same time, the storage capacitor Cst is charged to a voltage higher than the threshold voltage of the driving transistor DT to drive the driving transistor DT.

In the discharge phase B, the integrated circuit provides the first control signal Scan to the first scanning line SS1, the second control signal Scan2 to the second scanning line SS2, the data voltage signal Vdata[3*m*-2] to the data line DL3*m*-2, the black data voltage Vblack corresponding to the minimum data voltage (0V) to the data line DL3*m*-1 and the data line DL3*m*, and Vref to the reference signal line ref[m]. Because the first control signal Scan and the second control signal Scan2 are high levels, the first transistor ST1 and the second transistor ST2 turn on, a pixel current of the driving transistor DT is output to the reference signal line RLm through the second transistor ST2, and meanwhile, the voltage of the reference signal line RLm increases from Vref in direct proportion to the pixel current of the driving transistor DT until it is saturated after reaching a voltage corresponding to a difference Vdata[3*m*-2]-Vth between the data voltage signal Vdata[3*m*-2] and the threshold voltage of the driving transistor DT.

In the sampling phase C, the integrated circuit samples the saturation voltage Vdata[3*m*-2]Vth of the reference signal line ref[m], and determines the threshold voltage of the driving transistor DT in combination with the data voltage Vdata[3*m*-2], so as to complete detection of the threshold voltage of the driving transistor DT of the subpixel P1.

The working time sequence shown in FIG. 3*b* is similar to that shown in FIG. 3*a*, and the difference is that FIG. 3*b* shows detection of the threshold voltage of the driving transistor DT in the subpixel P2. Therefore, the integrated circuit provides a black data voltage Vblack to the data line DL3*m*-2, a data voltage signal Vdata[3*m*-1] to the data line DL3*m*-1, and a black data voltage Vblack to the data line DL3*m*.

The working time sequence shown in FIG. 3*c* is similar to that shown in FIG. 3*a*, and the difference is that FIG. 3*c* shows detection of the threshold voltage of the driving transistor DT in the subpixel P3. Therefore, the integrated circuit provides a black data voltage Vblack to the data line DL3*m*-2 and the data line DL3*m*-1, and provides a data voltage signal Vdata[3*m*] to the data line DL3*m*.

In the display phase of the organic light-emitting display panel, the integrated circuit provides a first control signal Scan1 to the first scanning line SS1, a second control signal Scan2 to the second scanning line SS2, a data voltage signal Vdata[3*m*-2] to the data line DL3*m*-2, a data voltage signal Vdata[3*m*-1] to the data line DL3*m*-1, a data voltage signal Vdata[3*m*] to the data line DL3*m*, and a reference voltage signal Vref to the reference signal line RLm. Because the first control signal Scan1 and the second control signal Scan2 are high levels, the first transistor ST1 and the second transistor ST2 in each of the subpixels P1, P2 and P3 turn on. Each storage capacitor Cst are respectively charged to a difference between each data voltage and the reference voltage, that is to say, the storage capacitor Cst of the subpixel P1 is charged to Vdata[3*m*-2]-Vref, the storage capacitor Cst of the subpixel P2 is charged to Vdata[3*m*-1]-Vref, and the storage capacitor Cst of the subpixel P3 is charged to Vdata[3*m*]-Vref. Then, the first control signal Scan1 and the second control signal Scan2 are changed into low levels, the first transistor ST1 and the second transistor ST2 in each subpixel are turned off, each driving transistor provides a current to each organic light-emitting diode (OLED) respectively, so that each organic light-emitting diode (OLED) emits light, and the organic light-emitting display panel is lightened.

In some optional implementations of the present embodiment, the threshold detection phase may further include a precharge phase not shown in FIGS. 3*a*-3*d*. In the precharge phase, the second control signal Scan2 provided by the integrated circuit to the second scanning line SS2 becomes a low level, and the second transistor ST2 is then turned off. At the same time, the integrated circuit provides a precharge voltage Vpre to the reference signal line ref[m], and the reference signal line ref[m] is then precharged to the precharge voltage Vpre. It should be appreciated that the precharge voltage Vpre is greater than the reference voltage Vref.

It should be appreciated that assuming that the time for detecting the threshold voltage of the driving transistor in each pixel driving circuit is T, when the organic light-emitting display panel shown in FIG. 1 includes 3 N columns of subpixels, the time for detecting the threshold voltage of each column of the subpixels is 3 T.

Figure 4:
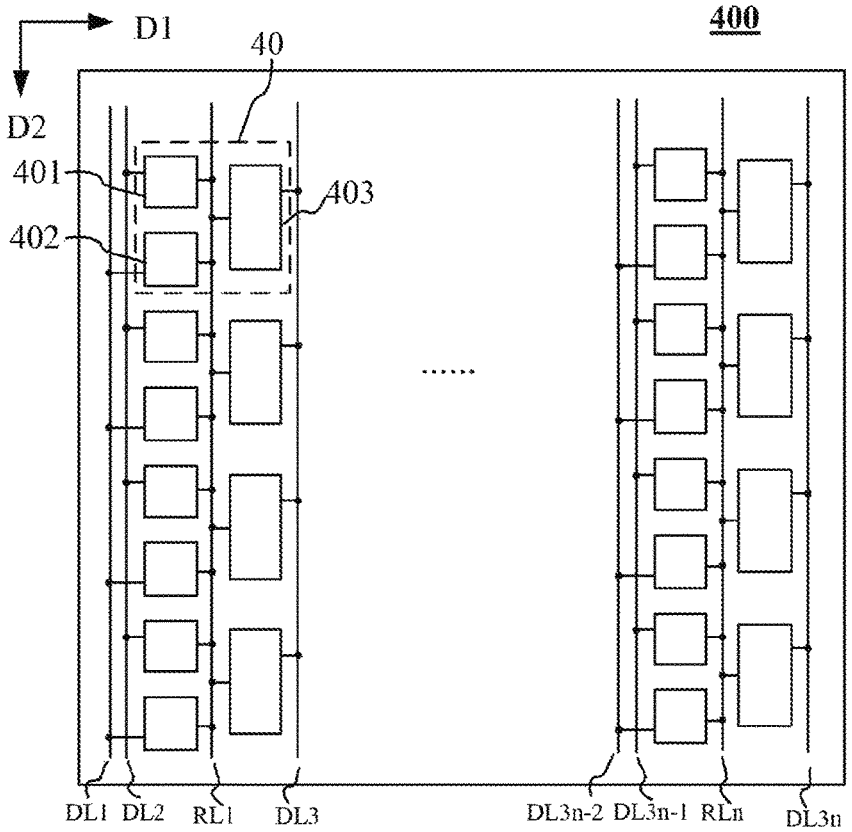
FIG. 4 is a structure diagram of another embodiment of the organic light-emitting display panel according to the present application.

FIG. 4 shows a structure diagram of another embodiment of the organic light-emitting display panel according to the present application. As shown in FIG. 4, the organic light-emitting display panel 400 of the present embodiment includes a plurality of pixel units 40, a plurality of data lines (DL1-DL3*n*) and a plurality of reference signal lines (RL1-RLn) in array arrangement. Wherein, each pixel unit 40 includes three subpixels, namely a first subpixel 401, a second subpixel 402 and a third subpixel 403. The first subpixel 401, the second subpixel 402, and the third subpixel 403 are electrically connected with different data lines, respectively. As shown in FIG. 4, the first subpixel 401 is electrically connected with the data line DL1, the second subpixel 402 is electrically connected with the data line DL2, and the third subpixel 403 is electrically connected with the data line DL3.

In the present embodiment, although the first subpixel 401 and the second subpixel 402 are arranged in a column direction (a second direction D2 in FIG. 4), the first subpixel 401 and the second subpixel 402 are electrically connected to different data lines, respectively. That is to say, the three subpixels in the identical pixel unit 40 are provided with data voltage signals by different data lines, respectively. It should be understood that the arrangement in the column direction in the present embodiment may refer to that the center of the first subpixel 401 and the center of the second subpixel 402 have a small distance to the center line of a minimum bounding rectangle formed by the first subpixel 401 and the second subpixel 402 in the column direction, and it should not be understood that the center of the first subpixel 401 and the center of the second subpixel 402 are both positioned on the center line of the minimum bounding rectangle formed by the first subpixel 401 and the second subpixel 402 in the column direction.

The first subpixel 401, the second subpixel 402 and the third subpixel 403 of the pixel unit 40 are electrically connected with a given reference signal line. As shown in FIG. 4, the first column of subpixels and the second column of subpixels are electrically connected with the reference signal line RL1, . . . , and the 2n−1 column of subpixels and the 2n column of subpixels are electrically connected with the reference signal line RLn.

Compared with the organic light-emitting display panel shown in FIG. 1, the difference is that among the three subpixels in the pixel unit 40 of the present embodiment, the size of at least one subpixel is different from that of the other two subpixels, and the pixel unit 40 has at least two subpixels arranged in a column direction (a second direction D2 in FIG. 4).

In the present embodiment, the sizes of the two subpixels arranged in the column direction may be smaller than the size of the other one subpixel in the pixel unit 40. As shown in FIG. 4, the size of the first subpixel 401 and the size of the subpixel 402 are smaller than the size of the third subpixel 403. It should be appreciated that the size of the first subpixel 401 may be identical or not identical to that of the second subpixel 402, which is not limited in the present embodiment.

Figure 5:
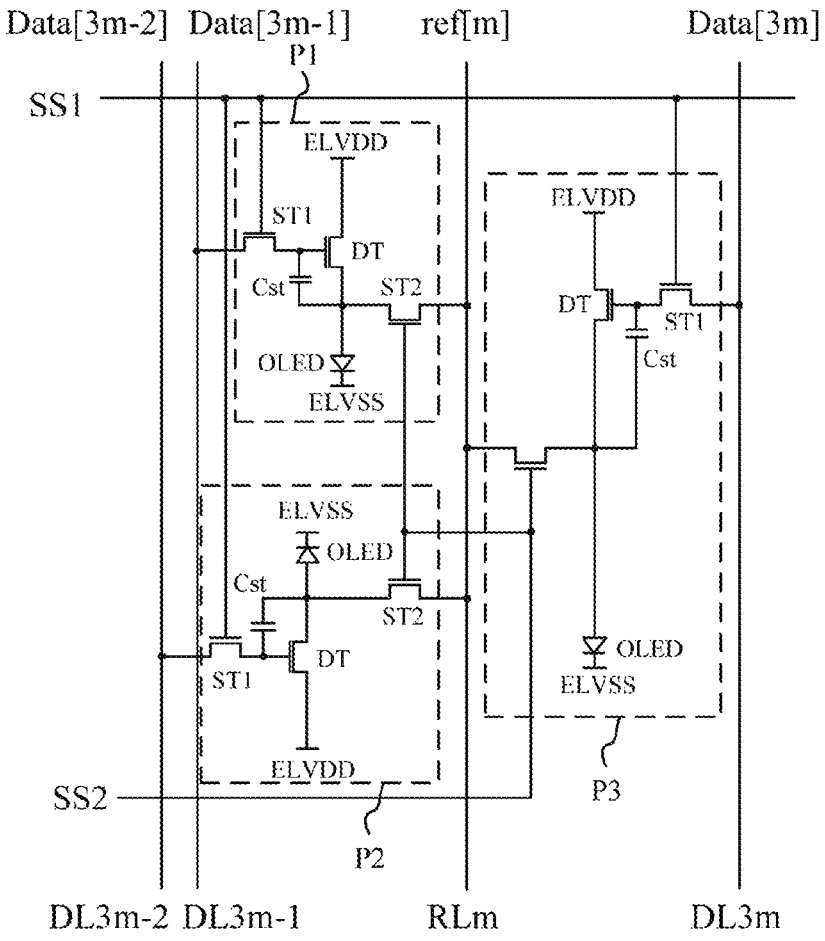
FIG. 5 is a structure diagram of a pixel driving circuit in a pixel unit of the organic light-emitting display panel shown in FIG. 4.

FIG. 5 shows a structure diagram of a pixel driving circuit of a pixel unit of the organic light-emitting display panel shown in FIG. 4. As shown in FIG. 5, the pixel unit of the organic light-emitting display panel includes subpixels P1, P2 and P3, and the pixel driving circuit of each subpixel drives each organic light-emitting diode (OLED). In the present embodiment, the pixel driving circuit of each subpixel is identical to the pixel driving circuit of each subpixel shown in FIG. 1, and includes a first transistor ST1, a second transistor ST2, a driving transistor DT and a storage capacitor Cst. A gate of the first transistor ST1 in each subpixel is electrically connected with the first scanning line SS1, and a gate of the second transistor ST2 in each subpixel is electrically connected with the second scanning line SS2. Also, in the present embodiment, the pixel driving circuit further comprises a plurality of data lines, wherein the subpixel P1 is electrically connected with the data line DL3*m*-1, the subpixel P2 is electrically connected with the data line DL3*m*-2, and the subpixel P3 is electrically connected with the data line DL3*m*.

Compared with the pixel driving circuit shown in FIG. 1, the difference is that in the present embodiment, the arrangement mode of the pixel driving circuit is identical to that of each subpixel, that is to say, a pixel area for the pixel driving circuit of each subpixel in an identical pixel unit is also of a type, different from an array arrangement mode of a pixel area for the pixel driving circuit of each subpixel in the identical pixel unit in FIG. 1.

The organic light-emitting display panel of the prior art usually adopts a pixel arrangement mode of RGBRGBRGB, sequentially arranged in a row direction, and each subpixel is provided with a reference signal line. In this way, not only is the space occupied by each pixel larger, but also a narrow frame of the organic light-emitting display device is difficult to realize. At the same time, each pixel driving circuit arranged on the array substrate and each subpixel have an identical arrangement mode, namely array arrangement. In this way, parasitic capacitances formed between a metal layer for the anode of each subpixel and the gate of the driving transistor DT will not be consistent. Because the anode of each subpixel is electrically connected with the anode of the organic light-emitting diode (OLED) through an anode line, the driving current flowing from the driving transistor DT to the organic light-emitting diode (OLED) is different, then the brightness of each subpixel is different and the display effect is influenced.

The organic light-emitting display panel provided by the above embodiment of the present application adopts a type pixel arrangement mode, and the corresponding pixel driving circuit also adopts the it type pixel arrangement mode at the same time, so that the parasitic capacitances formed between the metal layer for the anode of each subpixel and the gate of the driving transistor DT are unified to enable the light-emitting brightness of each subpixel to be identical and improve the display effect of the organic light-emitting panel; and meanwhile, the three subpixels of an identical unit are electrically connected with a given reference signal line, so that not only is the space occupied by the reference signal line in the organic light-emitting display panel effectively reduced to facilitate realization of a narrow frame, but also the load of the reference signal line electrically connected with the three subpixels of an identical pixel unit is identical, and the display effect is improved.

Because each of the pixel unit of the present embodiment and the pixel unit shown in FIG. 1 includes three subpixels, and the pixel unit of the present embodiment and the pixel driving circuit shown in FIG. 1 have an identical working time sequence. That is to say, the working time sequences shown in FIGS. 3*a*-3*d* are also applicable to the pixel driving circuit of the pixel unit of the present embodiment, which will not be repeated by present embodiment.

Figure 6:
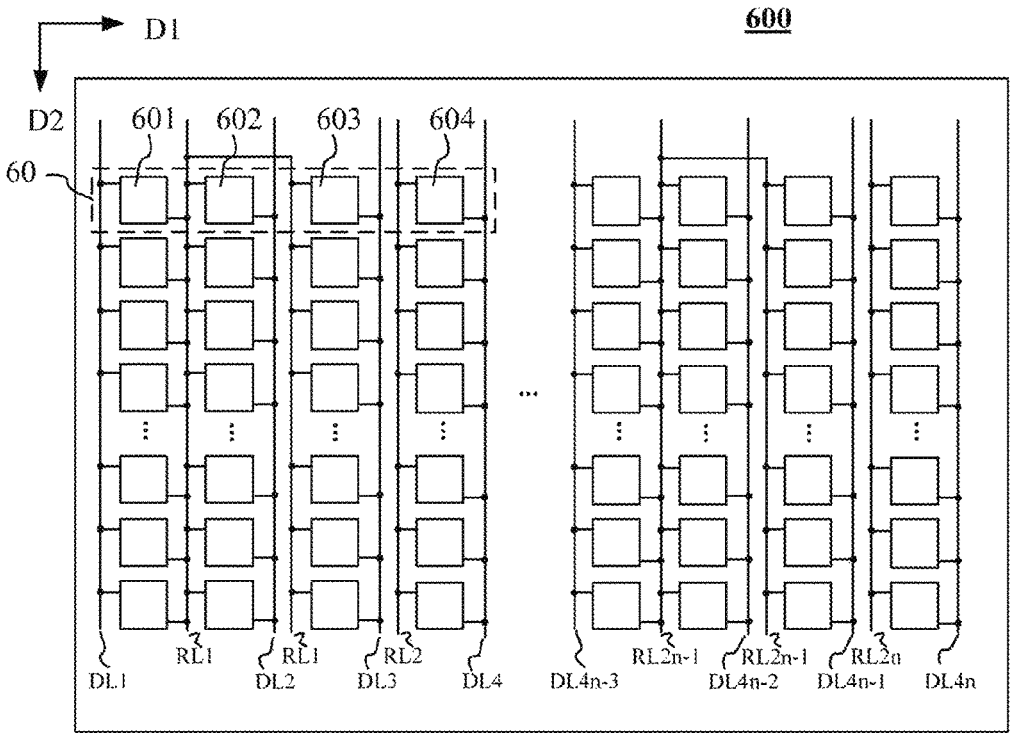
FIG. 6 is a structure diagram of another embodiment of the organic light-emitting display panel according to the present application.

FIG. 6 shows a structure diagram of another embodiment of the organic light-emitting display panel according to the present application. As shown in FIG. 6, the organic light-emitting display panel 600 of the present embodiment includes a plurality of pixel units 60, a plurality of data lines (DL1-DL4*n*) and a plurality of reference signal lines (RL1-RL2*n*) in array arrangement. Wherein, each pixel unit 60 includes four subpixels, namely a first subpixel 601, a second subpixel 602, a third subpixel 603 and a fourth subpixel 604. Compared with the organic light-emitting display panel shown in FIG. 1, the similarity is that each subpixel arranged in a column direction (a second direction D2 in FIG. 6) is electrically connected with a data line.

In the present embodiment, the first sub pixel 601, second pixel 602 and the third pixel 603 are electrically connected with a reference signal line, and the fourth subpixel 604 is electrically connected with another reference signal line, that is to say, one pixel unit 60 is electrically connected with two reference signal lines. As shown in FIG. 6, the first column of subpixels, the second column of subpixels and the third columns of subpixels are electrically connected with the reference signal line RL1, and the fourth column of subpixels is electrically connected with a reference signal line RL2.

In some optional implementations of the present embodiment, the fourth subpixel is a white subpixel W. A pixel arrangement mode of RGBW may greatly improve the light transmittance of the display panel and reduce the power consumption, so that picture levels are clearly demarcated and a picture is more transparent.

In the present implementation, because the lightening time of the white subpixel W is longer than that of the red subpixel R, the green subpixel G and the blue subpixel B, the driving module and the OLED of the white subpixel W are used longest in time and age more quickly. A single reference signal line is used to detect the threshold voltage of the driving transistor of the white subpixel W, which can improve the detection accuracy of the threshold voltage of the driving transistor of the white subpixel W; in addition, in the present implementation, the detection of the threshold voltage of the white subpixel W and the detection of the threshold voltages of the red subpixel R, the green subpixel G and the blue subpixel B may be configured to be carried out at the same time, which can effectively reduce the time for detecting the threshold voltages to improve the detection efficiency of the threshold voltages.

In the organic light-emitting display panel provided by the above embodiment of the present application, each pixel unit is configured to include four subpixels of RGBW, so that the display brightness of the organic light-emitting display panel is effectively improved and the power consumption is reduced; the three subpixels RGB are electrically connected to one reference signal line, the subpixel W is electrically connected to another reference signal line, and assuming that the time for detecting the threshold voltage of the driving module of each subpixel is T, the time for detection of the threshold voltage of the driving transistor of each of the four subpixels is only 3T, so that the detection efficiency of the threshold voltage is improved; and meanwhile, the number of metal wires in each pixel driving circuit is effectively reduced, thereby reducing the space occupied by the pixel driving circuit in the organic light-emitting display panel.

Figure 7:
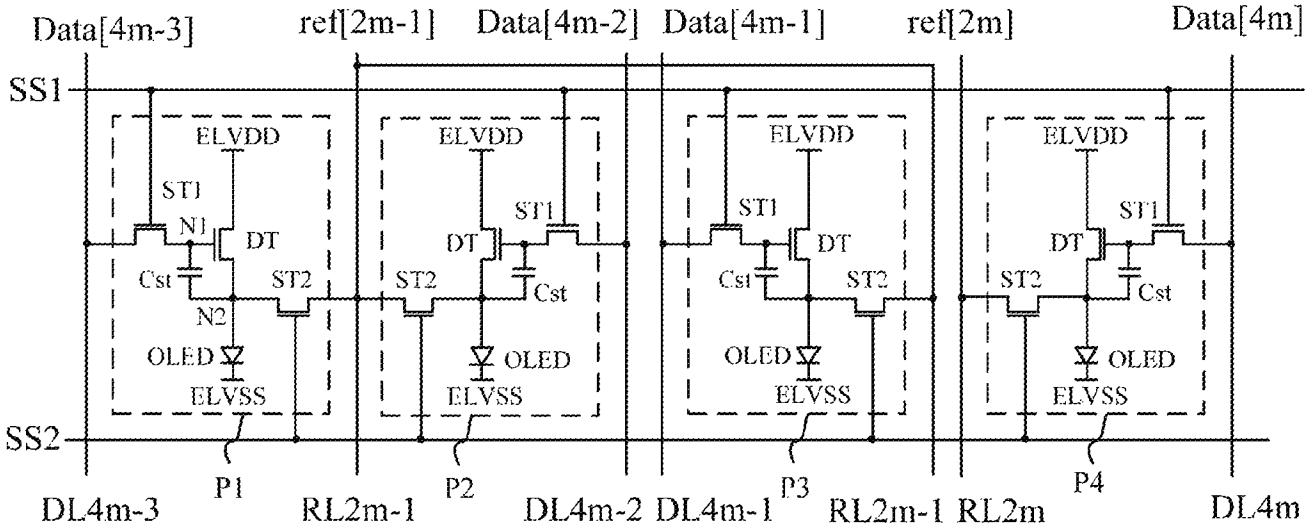
FIG. 7 is a structure diagram of a pixel driving circuit in a pixel unit of the organic light-emitting display panel shown in FIG. 6.

FIG. 7 shows a structure diagram of a pixel driving circuit according to the organic light-emitting display panel shown in FIG. 6. As shown in FIG. 7, the pixel unit of the organic light-emitting display panel includes subpixels P1, P2, P3 and P4, and each subpixel has an identical pixel driving circuit. The pixel driving circuit of each subpixel is identical to the pixel driving circuit shown in FIG. 2, and no more details will be provided here. In the present embodiment, second electrodes of the second transistors ST2 of the subpixels P1, P2 and P3 are electrically connected with a reference signal line RL2*m*-1, and a second electrode of the second transistor ST2 of the subpixel P4 is electrically connected with a reference signal line RL2*m*.

Figure 8A:
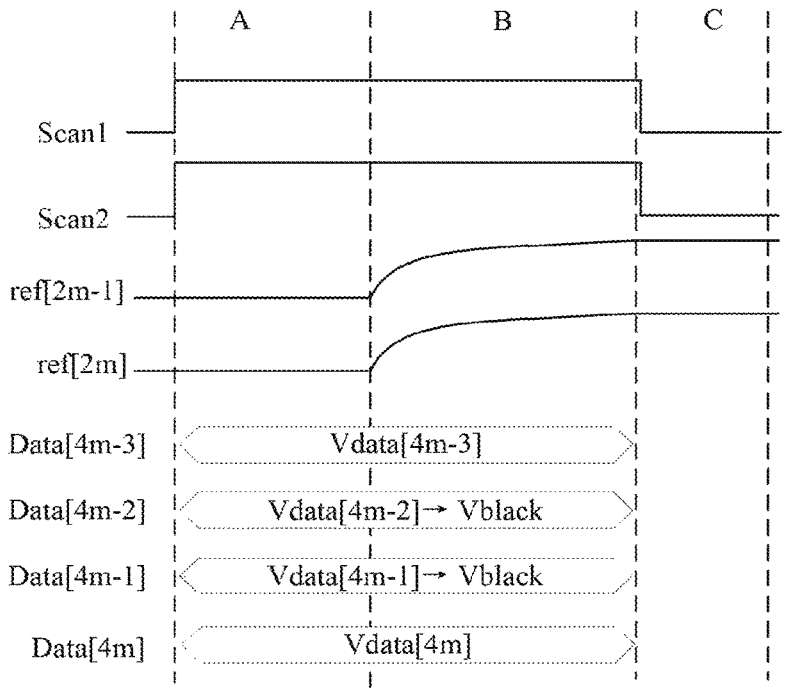
FIGS. 8*a*-8*d* are working time sequence diagrams of each pixel driving circuit of the pixel unit shown in FIG. 7 in different working phases.
Figure 8B:
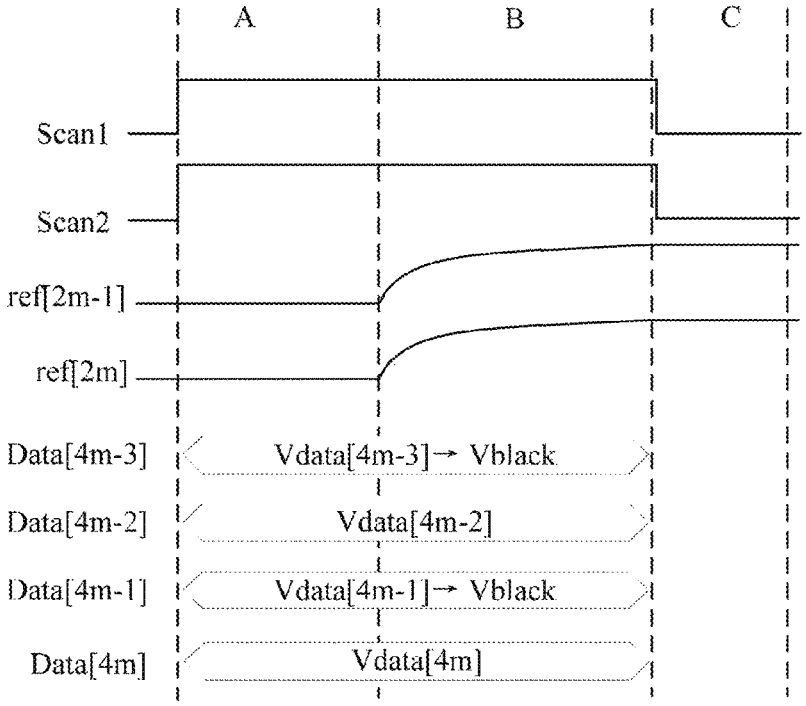
Figure 8C:
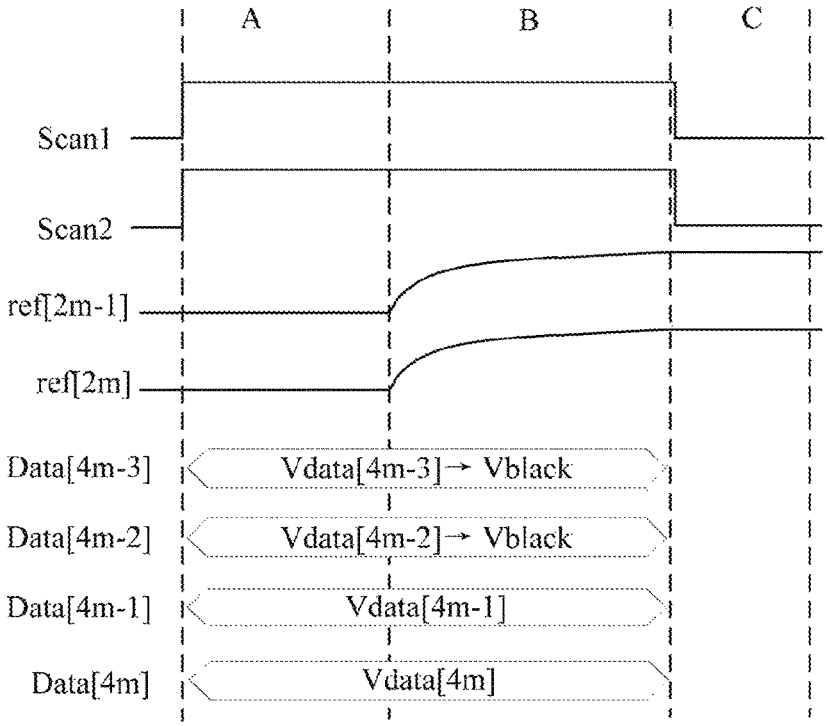
Figure 8D:
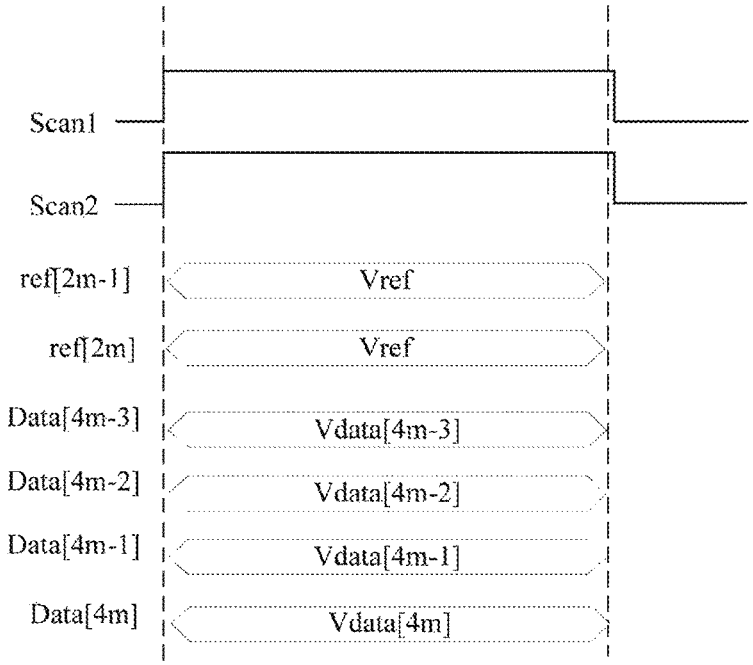

In combination with FIGS. 8*a*-8*d*, refer to a working time sequence of each pixel driving circuit in the pixel unit shown in FIG. 7. FIG. 8*a* is a working time sequence diagram of detection of the threshold voltages of the driving transistors of the first subpixel P1 and the fourth subpixel P4 of the pixel unit, FIG. 8*b* is a working time sequence diagram of detection of the threshold voltages of the driving transistors of the second subpixel P2 and the fourth subpixel P4 of the pixel unit, FIG. 8*c* is a working time sequence diagram of detection of the threshold voltages of the driving transistors of the third subpixel P3 and the fourth subpixel P4 of the pixel unit, and FIG. 8*d* is a working time sequence diagram of a display phase of the pixel unit. Wherein, a working time sequence shown in FIG. 8*a* is a first subphase of the threshold detection phase of the pixel unit, a working time sequence shown in FIG. 8*b* is a second subphase of the threshold detection phase of the pixel unit, and a working time sequence shown in FIG. 8*c* is a third subphase of the threshold detection phase of the pixel unit.

Similar to the working time sequence diagram shown in FIG. 3*a*, the threshold detection phase of each pixel shown in FIG. 8*a* may include an initialization phase A, a discharge phase B and sampling phase C.

In the initialization phase A, the integrated circuit provides a first control signal Scan1 and a second control signal Scan2 to the first scanning line SS1 and the second scanning line SS2 respectively, a data voltage signal Vdata[4m-3] to the data line DL4m-3, a black data voltage Vblack to the data line DL4m-2 and the data line DL4m-1, and a data voltage signal Vdata[4m] to the data line DL4m, thus, the subpixel P1 and the subpixel P4 are turned on, and the subpixel P2 and the subpixel P3 are turned off. The integrated circuit provides a reference voltage signal ref[m] to the reference signal line RL2m-1 and the reference signal line RL2m. Because the first control signal Scan1 and the second control signal Scan2 are high levels, the first transistors ST1 and the second transistors ST2 of the subpixel P1 and the subpixel P4 turn on, each first transistor ST transmits the data voltage signals Vdata[4m-3] and Vdata[4m] to a first node N1 respectively, and the second transistor ST2 transmits the reference voltage Vref to a second node N2 to complete initialization of the driving transistors of the subpixel P1 and the subpixel P4.

In the discharge phase B, the integrated circuit still provides the first control signal Scan1 and the second control signal Scan2 to the first scanning line SS1 and the second scanning line SS2 to turn the first transistors ST1 and the second transistors ST2 of the subpixel P1 and the subpixel P4 on, and pixel currents of the driving transistors DT of the subpixel P1 and the subpixel P4 are output to the reference signal line RL2m-1 and the reference signal line RL2m through each second transistor ST2 respectively, so that the voltages of the reference signal line RL2m-1 and the reference signal line RL2m increase from Vref in direct proportion to the pixel current of each driving transistor DT until they are saturated after reaching a voltage corresponding to a difference between the data voltage signal and the threshold voltage of the driving transistor DT. That is to say, the voltage of the reference signal line RL2m-1 is saturated after rising to Vdata[4m-3]-Vth, and the voltage of the reference signal line RL2m is saturated after rising to Vdata[4m]-Vth. The data signal provided by the integrated circuit to each data line is unchanged.

In the sampling phase C, the integrated circuit samples the saturation voltages Vdata[4m-3]-Vth and Vdata[4m]-Vth of the reference signal line RL2m-1 and the reference signal line RL2m, and determines the threshold voltages of the driving transistors DT of the subpixel P1 and the subpixel P2 in combination with the data voltages Vdata[4m-3] and Vdata[4m], so as to complete detection of the threshold voltages of the driving transistors DT of the subpixel P1 and the subpixel P4.

The working time sequence shown in FIG. 8b is similar to that shown in FIG. 8a, and the difference is that FIG. 8b shows detection of the threshold voltages of the driving transistors DT in the subpixel P2 and the subpixel P4. Therefore, the integrated circuit provides a black data voltage Vblack to the data line DL4m-3, a data voltage signal Vdata[4m-2] to the data line DL4m-2, a black data voltage Vblack to the data line DL4m-1, and a data voltage signal Vdata[4m] to the data line DL4m.

The working time sequence shown in FIG. 8c is similar to that shown in FIG. 8a, and the difference is that FIG. 8c shows detection of the threshold voltages of the driving transistors DT in the subpixel P3 and the subpixel P4. Therefore, the integrated circuit provides a black data voltage Vblack to the data line DL4m-3 and the data line DL4m-2, a data voltage signal Vdata[4m-1] to the data line DL4m-1, and a data voltage signal Vdata[4m] to the data line DL4m.

In the display phase of the organic light-emitting display panel, the integrated circuit provides a first control signal Scan and a second control signal Scan2 to the first scanning line SS1 and the second scanning line SS2 respectively to turn the first transistor ST1 and a second transistor ST2 of each subpixel on. The integrated circuit provides a voltage signal Vdata[4m-3] to the data line DL4m-3, a data voltage signal Vdata[4m-2] to the data line DL4m-2, a data voltage signal Vdata[4m-1] to the data line DL4m-1, and a data voltage signal Vdata[4m] to the data line DL4m. The integrated circuit provides a reference voltage signal Vref to the reference signal line RL2m-1 and the reference signal line RL2m. The storage capacitor Cst in each subpixel completes charging respectively. Then, the first control signal Scan1 and the second control signal Scan2 are changed into low levels, the first transistor ST1 and the second transistor ST2 in each subpixel are turned off, each driving transistor provides a current to each organic light-emitting diode (OLED) respectively, so that each organic light-emitting diode (OLED) emits light, and the organic light-emitting display panel is lightened.

Because the subpixel P4 is a white subpixel W and the usage time thereof is far longer than that of the subpixel P1, the subpixel P2 and the subpixel P3, the usage time of the driving transistor DT in the subpixel P4 is relatively long, and in order to detect the threshold voltage of the driving transistor DT of the subpixel P4 more precisely, the threshold voltage of the driving transistor DT of the subpixel P4 is detected for a plurality of times in the present embodiment.

It should be appreciated that in some optional implementations of the present embodiment, the threshold voltage of the driving transistor DT of the subpixel P4 may be detected once or twice, and the detection may be carried out synchronously with the detection of the threshold voltage of the driving transistor DT of any one or two of the subpixel P1, the subpixel P2 and the subpixel P3. In this way, compared with the working time sequences shown in FIGS. 3a-3d, when the organic light-emitting display panel includes a same number of columns of subpixels, the time for detecting the threshold voltage in the present embodiment is less than that required by FIGS. 3a-3d, so that the detection speed of threshold voltage can be increased.

Figure 9:
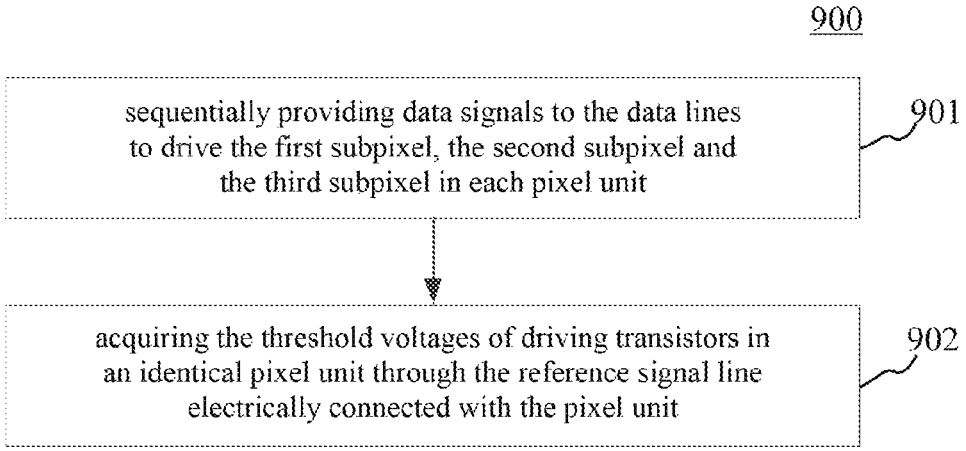
FIG. 9 is a flow diagram of one embodiment of the driving method of the organic light-emitting display panel according to the present application.

Continue to refer to FIG. 9, it shows a flow diagram 900 of one embodiment of the driving method of the organic light-emitting display panel according to the present application. The driving method of the present embodiment may be applied to the organic light-emitting display panel described in the above embodiment, and the working time of the organic light-emitting display panel includes a threshold detection phase. As shown in FIG. 9, the driving method of the present embodiment may include the following steps:

Step 901, sequentially providing data signals to the data lines to drive the first subpixel, the second subpixel and the third subpixel in each pixel unit.

In the present embodiment, the data signals may be sequentially provided to the data lines electrically connected with the first subpixel, the second subpixel and the third subpixel in the pixel unit to sequentially drive the first subpixel, the second subpixel and the third subpixel.

Step 902, acquiring the threshold voltages of driving transistors in an identical pixel unit through the reference signal line electrically connected with the pixel unit.

After the driving transistors of the first subpixel, the second subpixel and the third subpixel in the pixel unit are driven, the threshold voltage of each driving transistor in the pixel unit may be acquired through a reference signal line electrically connected with the pixel unit, and pixel compensation is then performed on each pixel unit according to the threshold voltage of each driving transistor.

In some optional implementations of the present embodiment, the organic light-emitting display panel further includes a plurality of scanning lines, and each pixel driving circuit in the pixel unit is electrically connected with a first scanning line and a second scanning line. The pixel driving circuit further includes a first transistor, a second transistor and a storage capacitor, wherein the first transistor is used for transmitting a data signal on a data line to a gate of the driving transistor based on a signal of the first scanning line, and the second transistor is used for transmitting a signal of a reference signal line to a second electrode of the driving transistor based on a signal of the second scanning line. The threshold detection phase includes a first subphase, a second subphase and a third subphase, and each of the first subphase, the second subphase and the third subphase includes an initialization phase, a discharge phase and a sampling phase. The driving method may further be implemented by the following steps not shown in FIG. 7:

In the initialization phase, providing a data voltage signal to a data line and a reference voltage signal to a reference signal line, the first transistor transmitting the data voltage signal to a grate of the driving transistor based on the first scanning line, and the second transistor transmitting the reference voltage signal to an anode of an organic light-emitting diode based on a signal of the second scanning line to complete initialization of the driving transistor and the organic light-emitting diode; in the discharge phase, continuing to provide a data voltage signal to the data line, the first transistor transmitting the data voltage signal to the gate of the driving transistor based on the first scanning line, and the second transistor transmitting the reference voltage signal to the anode of the organic light-emitting diode based on the second scanning line to enable the driving transistor to be saturated and drive a pixel current of the driving transistor to flow to the reference signal line; and in the sampling phase, the first transistor turning off based on the signal of the first scanning line and the second transistor turning off based on the signal of the second scanning line, acquiring saturation voltages on the reference signal line, and determining a threshold voltage of the driving transistor.

In some optional implementations of the present embodiment, the pixel unit may further include a fourth subpixel, and the reference signal line connected with the fourth subpixel is different from that connected with the first subpixel, the second subpixel and the third subpixel. The first subpixel, the second subpixel and the third subpixel are electrically connected with a first reference signal line, and the fourth subpixel is electrically connected with a second reference signal line. The first subphase of the driving method may specifically be implemented by the following steps not shown in FIG. 7:

In the initialization phase of the first subphase, providing a data voltage signal to the data line electrically connected with the first subpixel and the data line electrically connected with the fourth subpixel respectively to turn the first subpixel and the fourth subpixel on, providing a reference voltage signal to the first reference signal line and the second reference signal line respectively, the first transistors of the first subpixel and the fourth subpixel transmitting the data voltage signal to the gate of the driving transistor based on the signal of the first scanning line, and the second transistors of the first subpixel and the fourth subpixel transmitting the reference voltage signal to the anode of each organic light-emitting diode based on the signal of the second scanning line to complete initialization of the driving transistors and the organic light-emitting diodes of the first subpixel and the fourth subpixel; in the discharge phase of the first subphase, continuing to provide a data voltage signal to the data line electrically connected with the first subpixel and the data line electrically connected with the fourth subpixel, the first transistors of the first subpixel and the fourth subpixel transmitting the data voltage signals to the gate of the driving transistor based on the signal of the first scanning line, and the second transistors of the first subpixel and the fourth subpixel transmitting the reference voltage signal to the anode of the organic light-emitting diode based on the signal of the second scanning line to enable the driving transistors of the first subpixel and the fourth subpixel to be saturated, the pixel current of the driving transistor of the first subpixel to flow to the first reference signal line, and the pixel current of the driving transistor of the fourth subpixel to flow to the second reference signal line; and in the sampling phase of the first subphase, the first transistors of the first subpixel and the fourth subpixel turning off based on the signal of the first scanning line, and the second transistors of the first subpixel and the fourth subpixel turning off based on the signal of the second scanning line, acquiring saturation voltages on the first reference signal line and the second reference signal line respectively to determine the threshold voltages of the driving transistors of the first subpixel and the fourth subpixel.

In some optional implementations of the present embodiment, the working time of the organic light-emitting display panel further includes a light emitting phase, and the driving method includes: in the light emitting phase, providing a reference voltage signal to each reference data line, providing a data voltage signal to each data line, the first transistor transmitting the data voltage signal to the gate of the driving transistor based on the signal of the first scanning line, and the second transistor transmitting the reference voltage signal to the second electrode of the driving transistor based on the signal of the second scanning line to turn on the driving transistor and enable the organic light-emitting diode to emit light.

According to the driving method provided by the above embodiment of the present application, the threshold voltage of each driving transistor in the pixel unit can be effectively detected, the compensation of each pixel in the organic light-emitting display panel is then can be implemented, and the brightness of the organic light-emitting display panel is balanced.

Figure 10:
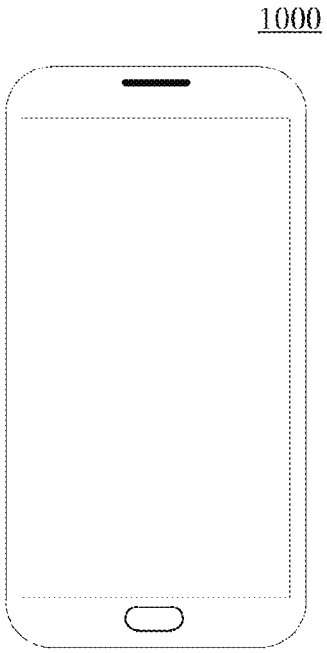
FIG. 10 is a structure diagram of one embodiment of the organic light-emitting display device according to the present application.

As shown in FIG. 10, the present application further provides an organic light-emitting display device 1000 including the organic light-emitting display panel described in the above embodiments. According to the organic light-emitting display device 1000, a plurality of pixels on the organic light-emitting display panel are divided into a plurality of pixel units, each pixel unit includes three subpixels, each column of the subpixels is electrically connected with a data line, and the three subpixels of an identical pixel unit are arranged in a row direction and are electrically connected with a given reference signal line. The organic light-emitting display panel of the present application effectively reduces the number of metal wires arranged in each pixel driving circuit, and reduces the space occupied in the OLED display device.

The above description only provides an explanation of the preferred embodiments of the present application and the technical principles used. It should be appreciated by those skilled in the art that the inventive scope of the present application is not limited to the technical solutions formed by the particular combinations of the above-described technical features. The inventive scope should also cover other technical solutions formed by any combinations of the above-described technical features or equivalent features thereof without departing from the concept of the disclosure. Technical schemes formed by the above-described features being interchanged with, but not limited to, technical features with similar functions disclosed in the present application are examples.

What is claimed is:

1. An organic light-emitting display panel, comprising:

an array arrangement comprising a plurality of pixel units, a plurality of data lines, a plurality of reference signal lines, a plurality of scanning lines and an integrated circuit, wherein the plurality of data lines, the plurality of reference lines and the plurality of scanning lines are electrically connected with the integrated circuit;

each pixel unit comprises a first subpixel, a second subpixel a third subpixel and a fourth subpixel, a color of the first subpixel, a color of the second subpixel and a color of the third subpixel differ from one another;

a pixel driving circuit is formed in each subpixel, and comprises a driving transistor and an organic light-emitting diode; and the first subpixel, the second subpixel and the third subpixel of an identical pixel unit are electrically connected with a given reference signal line;

each pixel driving circuit is electrically connected with a first scanning line and a second scanning line; the pixel driving circuit further comprises a first transistor, a second transistor and a storage capacitor, the first transistor is configured to transmit a data signal on the data line to a gate of the driving transistor based on a signal of the first scanning line, and the second transistor is configured to transmit a signal of the reference signal line to a second electrode of the driving transistor based on a signal of the second scanning line;

the first subpixel, the second subpixel and the third subpixel are electrically connected with a first reference signal line, and the fourth subpixel is electrically connected with a second reference signal line;

a working time of the organic light-emitting display panel comprises a threshold detection phase, the threshold detection phase comprises a first subphase, a second subphase and a third subphase, and each of the first subphase, the second subphase and the third subphase comprises an initialization phase, a discharge phase and a sampling phase;

in the initialization phase of the first subphase, the integrated circuit provides data voltage signals to the data line electrically connected with the first subpixel and the data line electrically connected with the fourth subpixel, respectively, to turn the first subpixel and the fourth subpixel on, provides reference voltage signals to the first reference signal line and the second reference signal line, respectively, the first transistors of the first subpixel and the fourth subpixel transmit the data voltage signals to the gate of the driving transistor based on the signal of the first scanning line, and the second transistors of the first subpixel and the fourth subpixel transmit the reference voltage signals to anodes of the organic light-emitting diodes based on the signal of the second scanning line, so that the driving transistors of the first subpixel and the fourth subpixel and the organic light-emitting diode complete initialization;

in the discharge phase of the first subphase, the integrated circuit continues to provide data voltage signals to the data line electrically connected with the first subpixel and the data line electrically connected with the fourth subpixel, respectively, the first transistors of the first subpixel and the fourth subpixel transmit the data voltage signals to the gate of the driving transistor based on the signal of the first scanning line, and the second transistors of the first subpixel and the fourth subpixel transmit the reference voltage signals to the anodes of the organic light-emitting diodes based on the signal of the second scanning line to saturate the driving transistors of the first subpixel and the fourth subpixel, enable a pixel current of the driving transistor of the first subpixel to flow to the first reference signal line, and enable a pixel current of the driving transistor of the second subpixel to flow to the second reference signal line; and in the sampling phase of the first subphase, the first transistors of the first subpixel and the fourth subpixel turn off based on the signal of the first scanning line, the second transistors of the first subpixel and the fourth subpixel turn off based on the signal of the second scanning line, respectively, and saturation voltages on the first reference signal line and the second reference signal line are acquired to determine threshold voltages of the driving transistors of the first subpixel and the fourth subpixel.

2. The organic light-emitting display panel according to claim 1, wherein the first subpixel, the second subpixel and the third subpixel are arranged in a row direction, and are equal in size.

3. The organic light-emitting display panel according to claim 1, wherein at least one subpixel existing in the pixel unit has a length in a column direction being greater than lengths of other two subpixels, and two subpixels in the pixel unit are arranged in the column direction.

4. The organic light-emitting display panel according to claim 3, wherein the first subpixel, the second subpixel and the third subpixel are a red subpixel, a green subpixel and a blue subpixel, respectively.

5. The organic light-emitting display panel according to claim 3, wherein the fourth subpixel is a white subpixel.

6. The organic light-emitting display panel according to claim 1, wherein the pixel driving circuit further comprises an electricity storage module, a data writing module and an initialization module; and the electricity storage module comprises a storage capacitor, the data writing module comprises a first transistor, and the initialization module comprises a second transistor.

7. The organic light-emitting display panel according to claim 1, wherein a gate of the first transistor is electrically connected with the first scanning line, a first electrode of the first transistor is electrically connected with the data line, and a second electrode of the first transistor is electrically connected with a gate of the driving transistor and one end of the storage capacitor;

a first electrode of the driving transistor is electrically connected with a first supply voltage, and a second electrode of the driving transistor is electrically connected with an anode of the organic light-emitting diode, a second electrode of the second transistor, and another end of the storage capacitor;

a gate of the second transistor is electrically connected with the second scanning line, and a first electrode of the second transistor is electrically connected with the reference signal line; and a cathode of the organic light-emitting diode is electrically connected with a second supply voltage.

8. The organic light-emitting display panel according to claim 6, wherein the driving transistor, the first transistor and the second transistor are P-type transistors.

9. The organic light-emitting display panel according to claim 1, wherein the working time of the organic light-emitting display panel further comprises a light emitting phase; and in the light emitting phase, the integrated circuit provides reference voltage signals to the reference data lines, and provides data voltage signals to the data lines, the first transistor transmits the data voltage signal to the gate of the driving transistor based on a signal of the first scanning line, and the second transistor transmits the reference voltage signal to the second electrode of the driving transistor based on a signal of the second scanning line, so as to turn on the driving transistor, and enable the organic light-emitting diode to emit light.

10. A method for driving the organic light-emitting display panel, applicable to the organic light-emitting display panel according to claim 1, and the method comprising:

in the initialization phase of the first subphase, providing data voltage signals to the data line electrically connected with the first subpixel and the data line electrically connected with the fourth subpixel, respectively, to turn the first subpixel and the fourth subpixel on, providing reference voltage signals to the first reference signal line and the second reference signal line, respectively, the first transistors of the first subpixel and the fourth subpixel transmitting the data voltage signals to the gate of the driving transistor based on the signal of the first scanning line, and the second transistors of the first subpixel and the fourth subpixel transmitting the reference voltage signals to the anodes of the organic light-emitting diodes based on the signal of the second scanning line, so that the driving transistors of the first subpixel and the fourth subpixel and the organic light-emitting diode complete initialization;

in the discharge phase of the first subphase, continuing to provide data voltage signals to the data line electrically connected with the first subpixel and the data line electrically connected with the fourth subpixel, respectively, the first transistors of the first subpixel and the fourth subpixel transmitting the data voltage signals to the gate of the driving transistor based on the signal of the first scanning line, and the second transistors of the first subpixel and the fourth subpixel transmitting the reference voltage signals to the anodes of the organic light-emitting diodes based on the signal of the second scanning line to saturate the driving transistors of the first subpixel and the fourth subpixel, enable a pixel current of the driving transistor of the first subpixel to flow to the first reference signal line, and enable a pixel current of the driving transistor of the second subpixel to flow to the second reference signal line; and in the sampling phase of the first subphase, the first transistors of the first subpixel and the fourth subpixel turning off based on the signal of the first scanning line, the second transistors of the first subpixel and the fourth subpixel turning off based on the signal of the second scanning line, respectively, and acquiring saturation voltages on the first reference signal line and the second reference signal line to determine threshold voltages of the driving transistors of the first subpixel and the fourth subpixel.

11. The method according to claim 10, wherein the working time of the organic light-emitting display panel further comprises a light emitting phase, and the method comprises:

in the light emitting phase, providing reference voltage signals to the reference data lines, providing data voltage signals to the data lines, the first transistor transmitting the data voltage signal to the gate of the driving transistor based on the signal of the first scanning line, and the second transistor transmitting the reference voltage signal to the second electrode of the driving transistor based on the signal of the second scanning line, so as to turn on the driving transistor, and enable the organic light-emitting diode to emit light.

12. An organic light-emitting display device, comprising the organic light-emitting display panel according to claim 1.

* * * * *